US005884358A

United States Patent [19]

Kim

[11] Patent Number: 5,884,358

[45] Date of Patent: Mar. 23, 1999

[54] HANDLE ASSEMBLY FOR A VACUUM CLEANER HAVING AN IMPROVED ROTATING CONNECTION PORTION

[75] Inventor: Yang-Rae Kim, Incheon, Rep. of Korea

[73] Assignee: Daewoo Electronics Co., Ltd., Rep. of Korea

[21] Appl. No.: 774,442

[22] Filed: Dec. 30, 1996

[30] Foreign Application Priority Data

Dec. 29, 1995 [KR] Rep. of Korea ..... 1995-65224

[51] Int. Cl.[6] ..... A47L 9/32

[52] U.S. Cl. ..... 15/339; 15/377; 15/410

[58] Field of Search ..... 15/377, 339, 410, 15/319

[56] References Cited

U.S. PATENT DOCUMENTS

| | | | |
|---|---|---|---|
| 4,980,945 | 1/1991 | Bewley | 15/339 |
| 5,109,568 | 5/1992 | Rohn et al. | 15/410 |

FOREIGN PATENT DOCUMENTS

| | | |
|---|---|---|
| 0 692 219 | 1/1996 | European Pat. Off. . |
| 0 727 172 | 8/1996 | European Pat. Off. . |

*Primary Examiner*—Chris K. Moore
*Attorney, Agent, or Firm*—Pillsbury Madison & Sutro, LLP

[57] ABSTRACT

A handle assembly for a vacuum cleaner having an improved rotating connection portion which is capable of rotatably connecting a rigid wand with a flexible hose of the vacuum cleaner, which has a simple internal structure, and can be manufactured at a low cost. The rotating connection portion is disposed between a connector for separably receiving an end of a rigid wand and a flexible hose of the vacuum cleaner. A suction control switch is installed in one side of the rotating connection portion. A first annular groove is formed through an outer periphery of a distal end of the connector, and an elastic C-shaped ring is inserted into and fixed in the first annular groove. A second annular groove is formed through an inner periphery of a front end of the rotating connection portion. When the distal end is inserted into the front end, C-shaped ring is elastically inserted into the second annular groove. Alternately, a first groove is formed through an outer periphery of a distal end of the connector, and a second groove is formed through an inner periphery of a front end of the rotating connection portion. When the distal end is inserted into the front end, an elastic hook-shaped fixing member is inserted into the second locking groove and the first groove in due sequence.

22 Claims, 6 Drawing Sheets

HANDLE ASSEMBLY FOR A VACUUM CLEANER HAVING AN IMPROVED ROTATING CONNECTION PORTION

BACKGROUND OF THE INVENTION

1. Field of the Invention

The present invention relates to a handle assembly for a vacuum cleaner, and more particularly to a handle assembly for a vacuum cleaner having an improved rotating connection portion which is capable of rotatably connecting a rigid wand with a flexible hose of the vacuum cleaner, has a simple internal structure and can be manufactured at a low cost.

2. Description of the Prior Art

A variety of vacuum cleaners for easily removing dust or other foreign substances piled up on furniture, a floor, or a carpet in a room have been proposed hitherto. Generally, vacuum cleaners can be classified into canister-type vacuum cleaners and upright-type vacuum cleaners.

A canister-type vacuum cleaner includes a body mounted on wheels and a hose assembly for sucking dust or other foreign substances into the body. A suction generating means such as a suction fan, a motor for driving the suction generating means, and a disposable dust container for filtering dust or other foreign substances from air sucked by the vacuum cleaner, are positioned in the body. A main brush and a suction nozzle are provided at a free end of the hose assembly.

An upright-type vacuum cleaner has a constitution which is similar to that of the canister-type vacuum cleaner. However, the upright-type vacuum cleaner differs in that it vacuums a surface directly beneath its body, so a hose assembly is not required.

These days, the canister-type vacuum cleaner is more frequently used in the home than the upright-type vacuum.

FIG. 6 illustrates a canister-type vacuum cleaner 100. Vacuum cleaner 100 includes a floor cleaning unit 110, a canister unit 120, and a hose assembly 130 extending between floor cleaning unit 110 and canister unit 120.

Floor cleaning unit 110 includes a main brush (not shown) or a suction nozzle (not shown), and the like. Floor cleaning unit 110 is detachably connected to hose assembly 130.

Canister unit 120 mainly includes a hood 122, a cover 124 and a body 126. Hood 122 encloses the dust collecting compartment and is pivotally installed onto body 126 so that the dust collecting compartment can be opened and closed. Hood 122 is provided with an inlet opening 127 formed through hood 122 for receiving hose assembly 130. Hood 122 also is provided with a transparent window 128 for notifying the user of the dust collecting state. Cover 124 encloses a motor compartment (not shown) where an electric motor and a suction fan driven by the electric motor are positioned. Further, a main electric cord 129 for applying an electric power from an external electric source to vacuum cleaner 100 is installed in the motor compartment. Main electric cord 129 is provided with a plug 129*a* at its free end.

Hose assembly 130 comprises a rigid wand 132 and a flexible hose 134, and is pneumatically connected to a dust collecting compartment (not shown) of canister unit 120 by a suction hose connector 136. Rigid wand 132 is rotatably connected to flexible hose 134 by a handle assembly 200.

Meanwhile, FIG. 7 illustrates the conventional handle assembly 200 in detail. Handle assembly 200 mainly includes a connector 131, a rotating connection portion 140 and a handle 170. A free end of connector 131 is detachably connected to an end of rigid wand 132. Pipe hose 131 is rotatably connected to flexible hose 134 by rotating connection portion 140.

Rotating connection portion 140 comprises an inner pipe 142 and an outer pipe 144. Inner pipe 142 is rotatably installed in outer pipe 144. Outer pipe 144 is integrally formed with connector 131. That is, outer pipe 144 extends downward from connector 131. In a front end of inner pipe 142, a ring-shaped packing pipe 150 is disposed on an outer periphery of inner pipe 142. Packing pipe 150 provides an airtight seal between inner pipe 142 and outer pipe 144. In a middle position of inner pipe 142, a ring-shaped first frame terminal 152*a* and a ring-shaped second frame terminal 152*b* are mounted to an outer surface of inner pipe 142. First frame terminal 152*a* and second frame terminal 152*b* include a plurality of iron cores which are installed therein.

Elastic third frame terminals 154 are disposed on a predetermined portion of outer pipe 144 which is brought into contact with first frame terminal 152*a* and second frame terminal 152*b*. When first frame terminal 152*a* and second frame terminal 152*b* rotate by rotating inner pipe 142 in relation to outer pipe 144, third frame terminals 154 always makes contact with first frame terminal 152*a* and second frame terminal 152*b*. An adapter pipe 156 is firmly fixed to inner pipe 142 by a first screw 158.

A ring-shaped cover terminal 155 is disposed to a lower end of inner pipe 142. Cover terminal 155 extends upward along inner pipe 142 and is electrically connected to a lower end of first frame terminal 152*a* and a lower end of second frame terminal 152*b*. A part of flexible hose 134 is fixed to the outer periphery of inner pipe 142, on which cover terminal 155 is disposed. In consideration of an external appearance of handle assembly 200, a cover hose 146 is mounted onto the part of flexible hose 134.

A first lead wire 157*a* is connected to a free end of cover terminal 155. First lead wire 157*a* extends from the free end of cover terminal 155 to the motor compartment of canister unit 120 along flexible hose 134, and is connected to a printed circuit board (not shown, hereinafter referred to "PCB") which is installed in the motor compartment.

Meanwhile, second lead wires 157*b* are connected to an end of first frame terminal 152*a*. Second lead wire 157*b* extends from the end of first frame terminal 152*a* to an interior of handle 170 through a through hole 159 which is formed through a partition wall 131*b* between connector 131 and handle 170. Second lead wire 157*a* extending into the interior of handle 170 is connected to both ends of a slide volume 166 of a suction control switch 160 which is installed in the interior of handle 170.

Suction control switch 160 mainly includes an operation knob 162, a supporting plate 164, and slide volume 166, which is a variable resistor. Operation knob 162 slideably moves along a slide opening which is formed through a cover 172 of handle 170. Operation knob 162 slideably makes contact with slide volume 166. Slide volume 166 is fixed to partition wall 131*a* and a bottom wall 176 of handle 170 by a plurality of second screws 168. Cover 172 of handle 170 is fixed to partition wall 131*a* and bottom wall 176 of handle 170 by a plurality of third screws 178.

When a user wants to perform a cleaning job by using vacuum cleaner 100 as described above, the user inserts plug 129*a* of main electric cord 129 into an outlet wall (not shown). Thereafter, the user starts a suction operation by turning on suction control switch 160. Under this state, the user of vacuum cleaner 100 slideably moves floor cleaning unit 110 along the surface to be cleaned so that the cleaning job can be performed. At this time, inner pipe 142 and outer pipe 144 of handle assembly 200 can rotate together in 360 degrees. Accordingly, the user of vacuum cleaner 100 can perform the cleaning job by moving handle assembly 200 into various positions as needed, and can prevent flexible hose 134 from twisting during use.

However, in the conventional handle assembly 200, in order to always provide an electrical connection between suction control switch 160 which is installed in handle 170 and an outer electric source (not shown), and in order to allow for the rotation of handle 170, it is required that first frame terminal 152*a*, second frame terminal 152*b*, third frame terminal 154 and cover terminal 155 are installed in handle assembly 200. Accordingly, an internal structure of handle assembly 200 is complicated, and handle assembly 200 frequently breaks down. Further, the manufacturing cost of handle assembly 200 is high. In addition, second lead wire 157*b* extending between slide volume 166 of handle 170 and first frame terminal 152*a* can become twisted or can experience a short.

U.S. Pat. No. 5,109,568 issued to Dean R. Rohn et al. on May 5, 1992 discloses a handle assembly for securing a vacuum hose to an intake nozzle of a vacuum cleaner. Dean R. Rohn et al.'s handle assembly includes a first mating handle housing section and a second mating handle housing section which are provided with a plurality of oppositely facing ridges and oppositely facing grooved portions. When a user of the vacuum cleaner connects the vacuum hose to the intake nozzle, the first mating handle housing section and the second mating handle housing section are tightly engaged with an end of the vacuum hose and a shoulder portion of a elbow section, respectively by the ridges and the grooved portions. Accordingly, in Dean R. Rohn et al.s' handle assembly, when the user performs a cleaning job by moving the handle assembly into various positions, clockwise or counter-clockwise rotation of the vacuum hose is prevented.

However, Dean R. Rohn et al.s' handle assembly is contrived to prevent the vacuum hose from rotating during the use of the vacuum cleaner. Therefore, Dean R. Rohn et al.s' handle assembly does not employ a special connection means for rotatably connecting the vacuum hose to the suction nozzle in order to prevent the vacuum hose from running during the use of the vacuum cleaner.

SUMMARY OF THE INVENTION

The present invention is contrived to solve the foregoing problems. It is an object of the present invention to provide a handle assembly for a vacuum cleaner having an improved rotating connection portion which is capable of rotatably connecting a rigid wand with a flexible hose of the vacuum cleaner, has a simple internal structure and can be manufactured at a low cost.

In order to achieve the above object, the present invention provides a handle assembly for a vacuum cleaner, the handle assembly comprising:

- a connector for separably receiving an end of a rigid wand of a vacuum cleaner;
- a handle curved to a predetermined shape so that a user of the vacuum cleaner can conveniently grip the handle by hand, the handle being integrally formed with the connector; and
- a rotating connection portion for rotatably connecting the connector with a flexible hose of the vacuum cleaner, the rotating connection portion having a suction control switch which is installed at a side portion of the rotating connection portion.

The connector includes a button section, a supporting means for elastically supporting the button section, and a rib for fixing the supporting means and a cover mounted on the rib. The button section is exposed to an outside of the cover so that the user can press the button section by hand. The supporting means is positioned below the button section. The rib extendes in the horizontal direction from a free end of the connector to an interior of the handle.

The button section is exposed to the outside of the cover through an opening which is formed through the cover. The button section includes a body, a bracket for fixing an upper end of the supporting means, and a protrusion. The bracket extends downward from the body, and the protrusion extends in the horizontal direction from the body toward an opening end of the pipe hose. The protrusion is inserted in a locking groove which is formed through an outer periphery of the rigid wand, when the rigid wand is inserted into the pipe hose.

Preferably, the supporting means is a compression spring.

The suction control switch includes an operation knob, a variable resistor for changing a voltage applied to a driving motor of the vacuum cleaner in accordance with a displacement of the operation knob, a lead wire for applying an electric power from an outer electric source to the variable resistor and for applying a changed voltage which is changed by the variable resistor to the driving motor, and a switch cover for enclosing the operation knob, the variable resistor, and the lead wire. The operation knob is exposed to an outside so that a user of the vacuum cleaner controls an operation of the vacuum cleaner. The variable resistor is slideably brought into contact with the operation knob. The lead wire is connected to a lower end of the variable resistor.

The operation knob is exposed to the outside of the switch cover through a groove which is formed through a frame of the rotating connection portion. The operation knob slideably moves in the longitudinal direction along the sliding groove and slideably makes contact with the variable resistor, when the user operates the operation knob in order to change a voltage applied to the driving motor.

The lead wire extending from the lower end of the variable resistor is electrically connected to an inner wire which extends from the outer electric source into the flexible hose.

The connector includes a first annular groove which is formed through an outer periphery of a distal end of the connector, and an elastic C-shaped ring which is inserted into and fixed in the first annular groove. The rotating connection portion includes a second annular groove which is formed through an inner periphery of a front end of the rotating connection portion. The second annular groove corresponds to the first annular groove.

The C-shaped ring is elastically inserted into the second annular groove at the time that the distal end is inserted into the front end. Thereby, the connector and the rotating connection portion are rotatably connected with each other.

The connector includes a first groove which is formed through an outer periphery of a distal end of the connector. The rotating connection portion includes a second groove which is formed through an inner periphery of a front end of the rotating connection portion. When the distal end is inserted into the front end, an elastic hook-shaped fixing member is inserted into the second groove and the first locking groove in due sequence. Thereby, the connector and the rotating connection portion are rotatably connected with each other. The second groove corresponds to the first groove.

As described above, in the handle assembly of the vacuum cleaner according to the preferred embodiments of the present invention, the suction control switch, which is improved as compared with the conventional suction control switch, is installed in the rotating connection portion, and the elastic C-shaped ring or the elastic hook-shaped fixing member is disposed at the combining portion between the connector and the rotating connection portion. As a result, it is possible to obtain a handle assembly having a simple internal structure and a low manufacturing cost.

Further, since the rigid wand and the flexible hose of the vacuum cleaner can rotate together in 360 degrees, a user of the vacuum cleaner can perform a cleaning job by moving the handle assembly into various positions as needed. In addition, it is possible to effectively prevent the flexible hose from twisting during the use of the vacuum cleaner. Further, it is possible to effectively prevent the lead wire from twisting or shorting during the use of the vacuum cleaner.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiment of the present invention will be explained in more detail with reference to the accompanying drawings.

Figure 1:
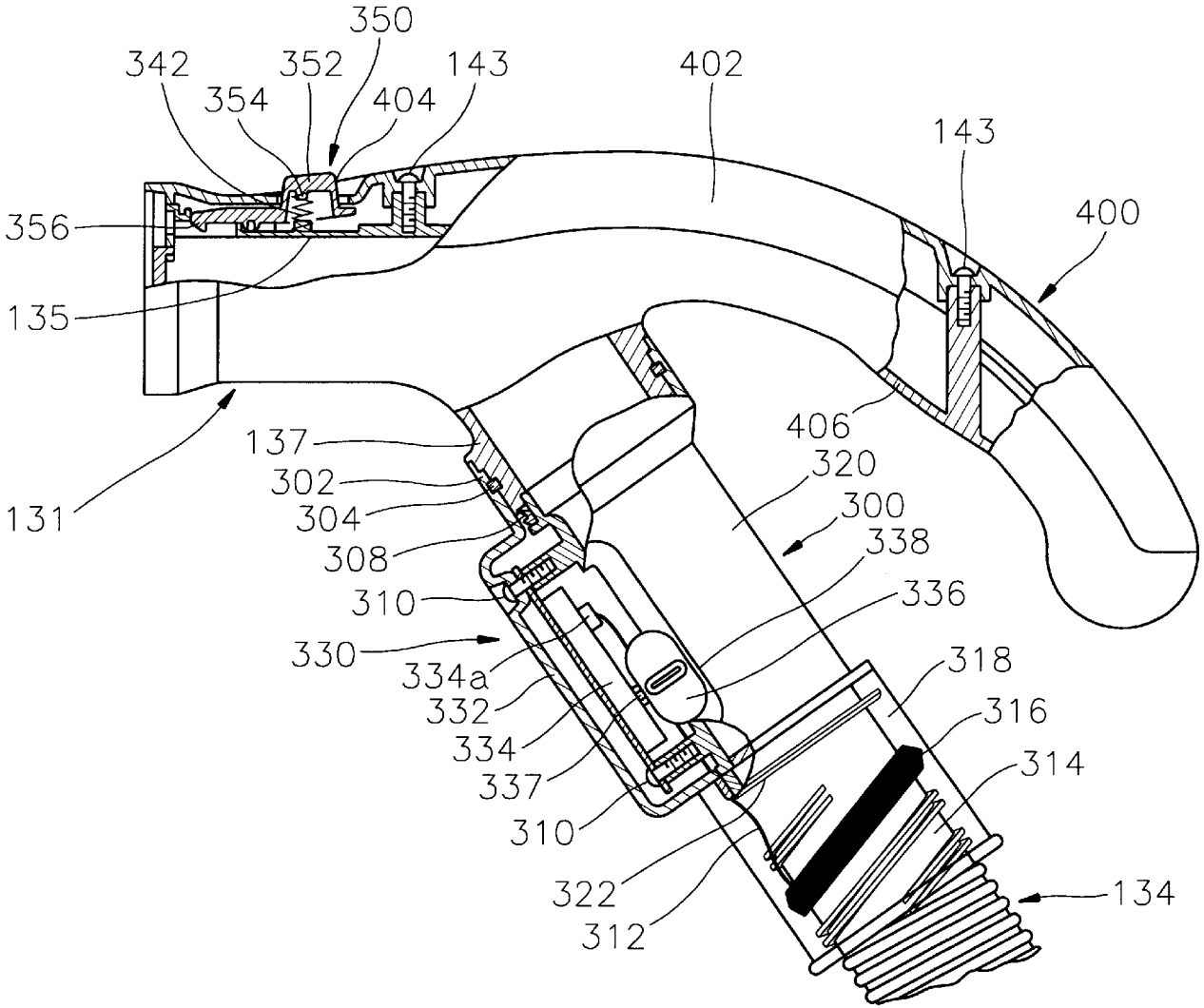
FIG. 1 is a partially exploded sectional view of a handle assembly for a vacuum cleaner according to a preferred first embodiment of the present invention.

FIG. 1 illustrates a handle assembly 500 for a vacuum cleaner according to a preferred first embodiment of the present invention. Handle assembly 500 mainly includes a connector 131, a rotating connection portion 300 and a handle 400. Preferably, connector 131, rotating connection portion 300 and handle 400 are injection molded from plastic, but may be made from a variety of materials such as a metal. A free end of connector 131 is detachably connected to an end of rigid wand 132. Connector 131 is rotatably connected to flexible hose 134 by rotating connection portion 300. A front end 302 of rotating connection portion 300 is rotatably connected to a distal end 137 of connector 131.

Figure 2:
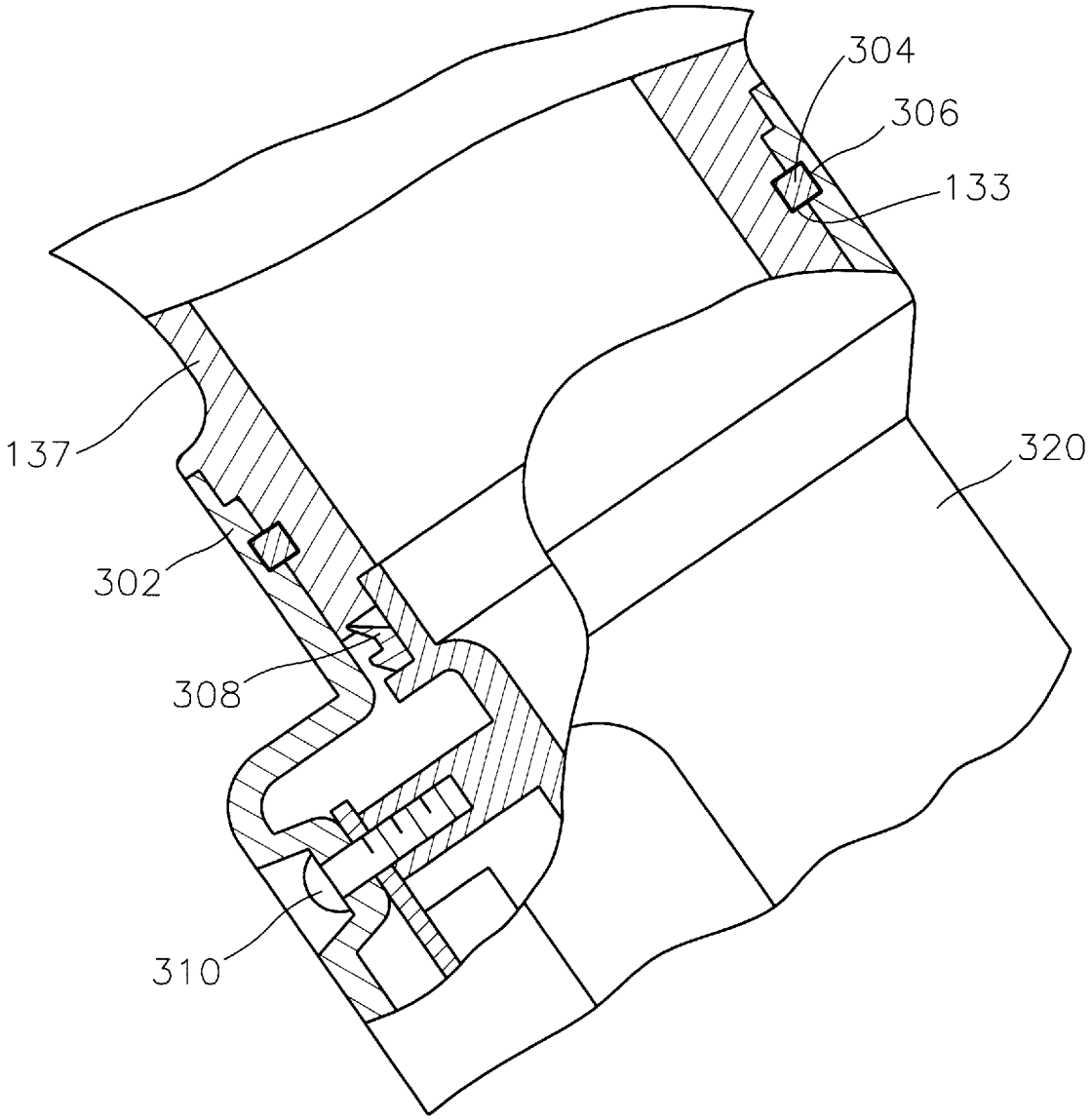
FIG. 2 is a partially enlarged view of the handle assembly illustrated in FIG. 1.

FIG. 2 illustrates in detail a combining portion between distal end 137 of connector 131 and front end 302 of rotating connection portion 300. A first annular groove is 133 is formed on an outer periphery of distal end 137 of connector 131. An elastic C-shaped ring 304 is inserted into and fixed in first annular groove 133. A second annular groove 306 is formed on an inner periphery of front end 302 of rotating connection portion 300. Second annular groove 306 corresponds to first annular groove 133.

When distal end 137 of connector 131 is inserted into front end 302 of rotating connection portion 300 in order to rotatably connect pipe hose 131 with flexible hose 134, C-shaped ring 304 is slideably inserted into second annular groove 306. That is, if a user of vacuum cleaner 100 pushes distal end 137 of connector 131 towards rotating connection portion 300 in order to rotatably connect connector 131 with flexible hose 134, C-shaped ring 304 is pushed and inserted into second annular groove 306 by a force applied by the user. Thereby, distal end 137 of connector 131 and front end 302 of rotating connection portion 300 are connected to each other.

If the user rotates handle 400 under the state that distal end 137 of connector 131 and front end 302 of rotating connection portion 300 are connected with each other as described above, C-shaped ring 304 rotates in second annular groove 306 in accordance with the rotating of distal end 137 of connector 131 in relation to front end 302 of rotating connection portion 300. As a result, connector 131 and rotating connection portion 300 can rotate together in 360 degrees.

Referring to FIG. 1 again, in the combining portion of distal end 137 of connector 131 and front end 302 of rotating connection portion 300, a sealing member 308 for providing an airtight seal is disposed on the outer periphery of front end 302.

A suction control switch 330 is installed at a slide portion of rotating connection portion 300. Suction control switch 330 starts an operation of vacuum cleaner 100, and controls a suction force established by a motor (not shown). Suction control switch 330 mainly includes a switch cover 332, a variable resistor 334 and an operation knob 336. Variable resistor 334 is provided with the PCB therein. Slide volume 334 changes a voltage which is applied to the motor of vacuum cleaner 100, in accordance with a displacement of operation knob 336.

Operation knob 336 slideably makes contact with 334 through a leg 337 extending from operation knob 336 into slide volume 334. Operation knob 336 is exposed to an outside of the switch cover 332 through a groove 338 which is formed through a frame 320 of rotating connection portion 300. When a user of the vacuum cleaner 100 operates operation knob 336 in order to change a voltage applied to the motor, operation knob 336 slideably moves in the longitudinal direction along groove 338, and slideably makes contact with variable resistor 334 through leg 337. Switch cover 332 and slide volume 334 are fixed to frame 320 by a plurality of first screws 310.

A lead wire 312 is connected to a lower end 334*a* of variable resistor 334. Lead wire 312 extends from lower end 334*a* of variable resistor 334 to a lower end 314 of rotating connection portion 300. In lower end 314 of rotating connection portion 300, lead wire 312 is connected to an inner electric wire (not shown) extending from the motor compartment into rotating connection portion 300 along flexible hose 134. After lead wire 312 is welded to the inner electric wire, lead wire 312 is fixed to lower end 314 by an insulating vinyl tape 316. Thereby, suction control switch 330 is electrically connected to an outer electric source via the motor compartment.

When an electrical connection between lead wire 312 and the inner electric wire is completed, a cover hose 318 is mounted onto lower end 314 of rotating connection portion 300 in consideration of an external appearance of handle assembly 500. Cover hose 318 is mounted onto a rib 322 which is formed on frame 320.

Meanwhile, a button section 350 for separably receiving an end of rigid wand 132 is installed at an upper portion of connector 131. Button section 350 is exposed to an ambient so that a user of vacuum cleaner 100 can press button pipe 350 by hand. That is, button pipe 350 is exposed to an outside through an opening 404 which is formed through a cover 402 of handle 400. Button section 350 includes a body 352, a bracket 354 and a locking protrusion 356. Fixing member 354 extends downward from body 352. Locking protrusion 356 extends in the horizontal direction from body 352 to an open end of connector 131. When a user of the vacuum cleaner 100 presses button section 350 in order to insert an end of rigid wand 132 into connector 131, locking protrusion 356 is inserted into a groove (not shown) which is formed on an outer periphery of rigid wand 132.

Button section 350 is elastically supported by a compression spring 342. For this purpose, an upper end of compression spring 342 is fixed to bracket 354 of connector 131. A lower end of compression spring 342 is fixed to a rib 135 extending the horizontal direction from a free end of connector 131 to an interior of handle 400. Handle 400 is integrally formed with connector 131.

Handle 400 is designed to have a desired shape on the basis of a human engineering, thereby a user of vacuum cleaner 100 can conveniently grip handle 400 by hand. Cover 402 of handle 400 is fixed to rib 135 and a bottom wall 406 of handle 400 by a plurality of second screws 143.

Figure 3:
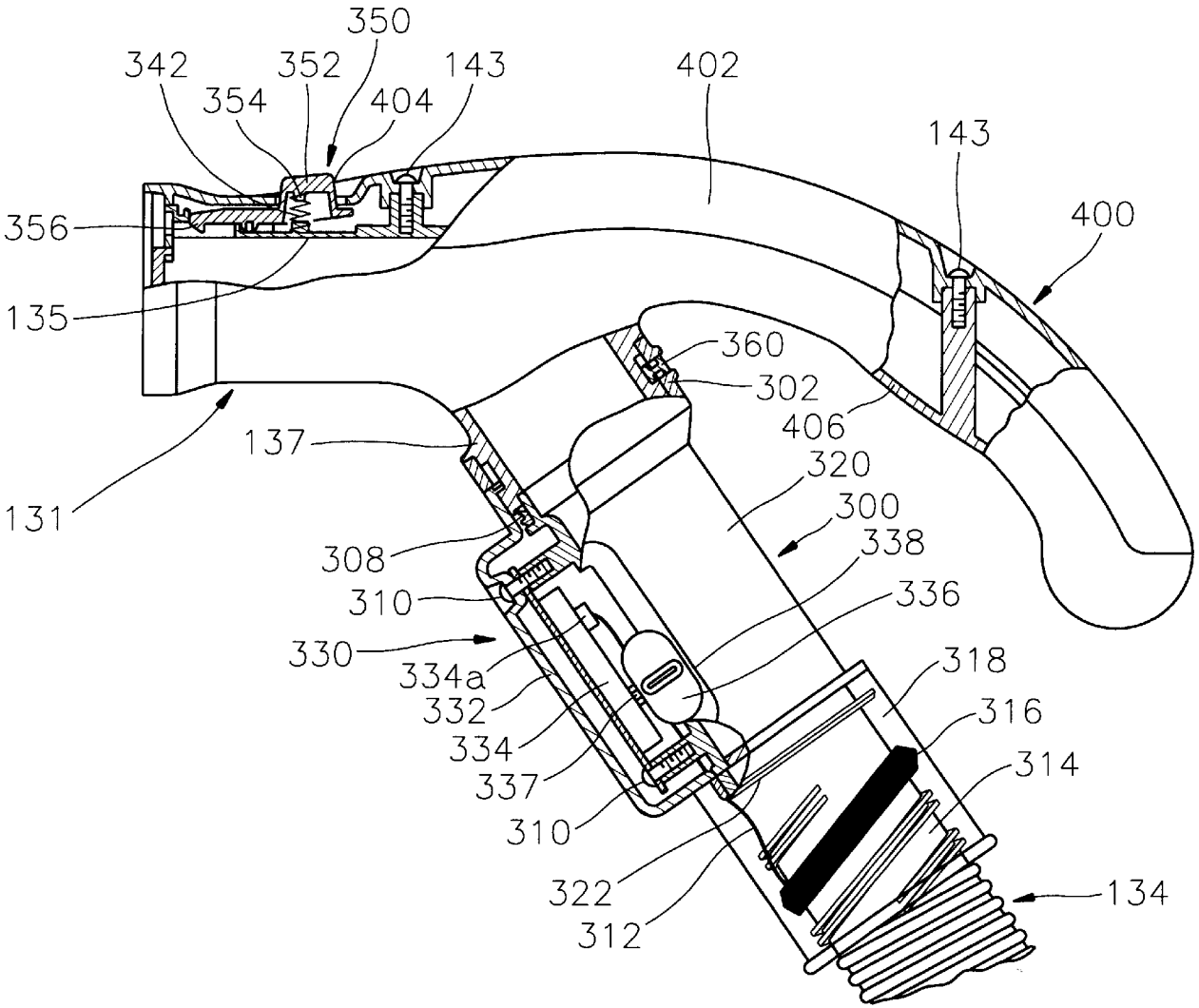
FIG. 3 is a partially exploded sectional view of a handle assembly for a vacuum cleaner according to a preferred second embodiment of the present invention.

FIG. 3 illustrates a handle assembly 500*a* for a vacuum cleaner according to a preferred second embodiment of the present invention. Handle assembly 500*a* has the same constitution as handle assembly 500 according to the preferred first embodiment of the present invention, except that a hook-shaped fixing member 360 is disposed at a combining portion between distal end 137 of connector 131 and front end 302 of rotating connection portion 300, instead of C-shaped ring 304. Accordingly, descriptions of constitutional elements which are identical to the constitutional elements of handle assembly 500 according to the preferred first embodiment of the present invention will be omitted. Further, inventive elements which are identical to the inventive elements used in the preferred first embodiment of the present invention have the same reference numerals.

In the same manner as the first embodiment of the present invention, connector 131 of handle assembly 500*a* is rotatably connected to flexible hose 134 by rotating connection portion 300. That is, distal end 137 of connector 131 is rotatably connected to front end 302 of rotating connection portion 300.

Figure 4:
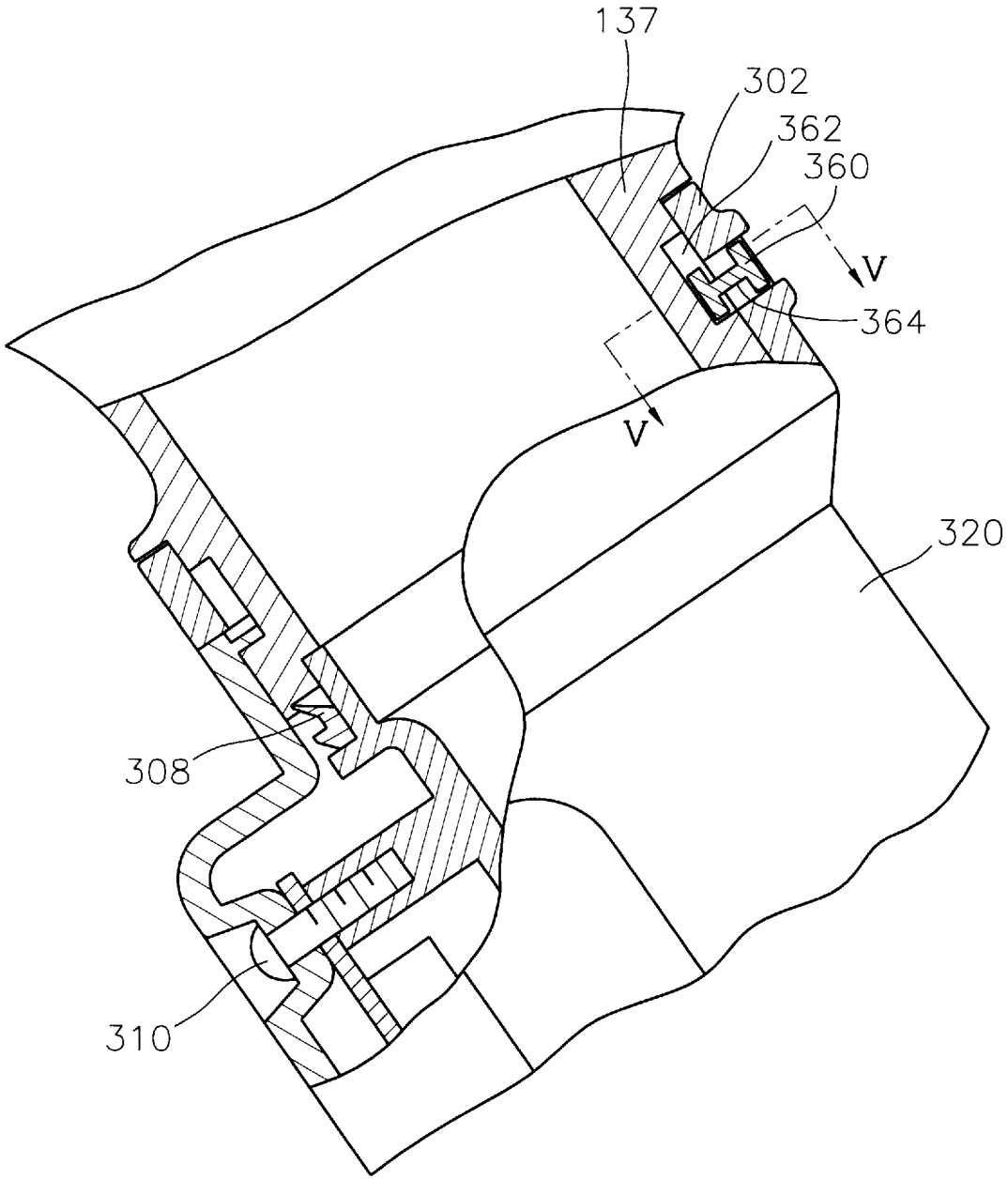
FIG. 4 is a partially enlarged view of the handle assembly illustrated in FIG. 3.
Figure 5:
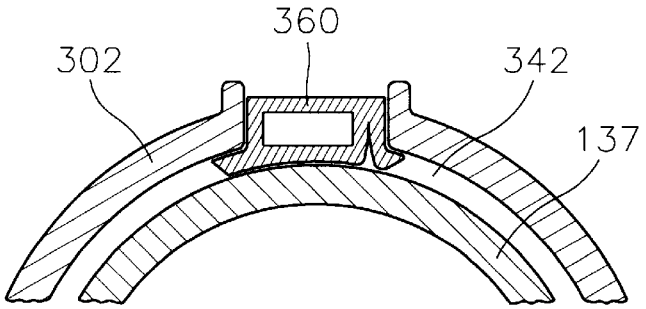
FIG. 5 is a cross-sectional view taken along line V—V shown in FIG. 4.
Figure 6:
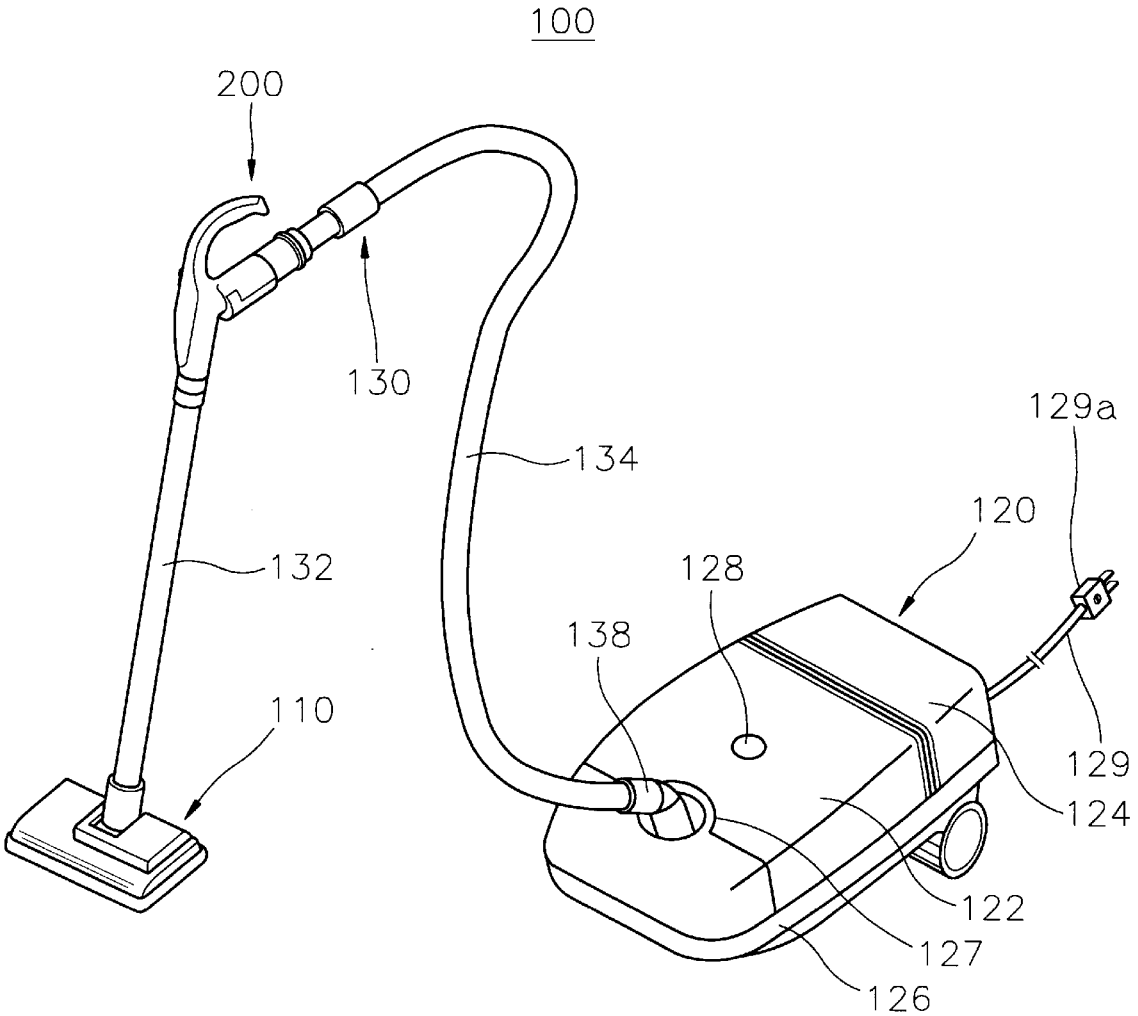
FIG. 6 (PRIOR ART)
FIG. 6 is a perspective view of a canister-type vacuum cleaner according to the prior art.
Figure 7:
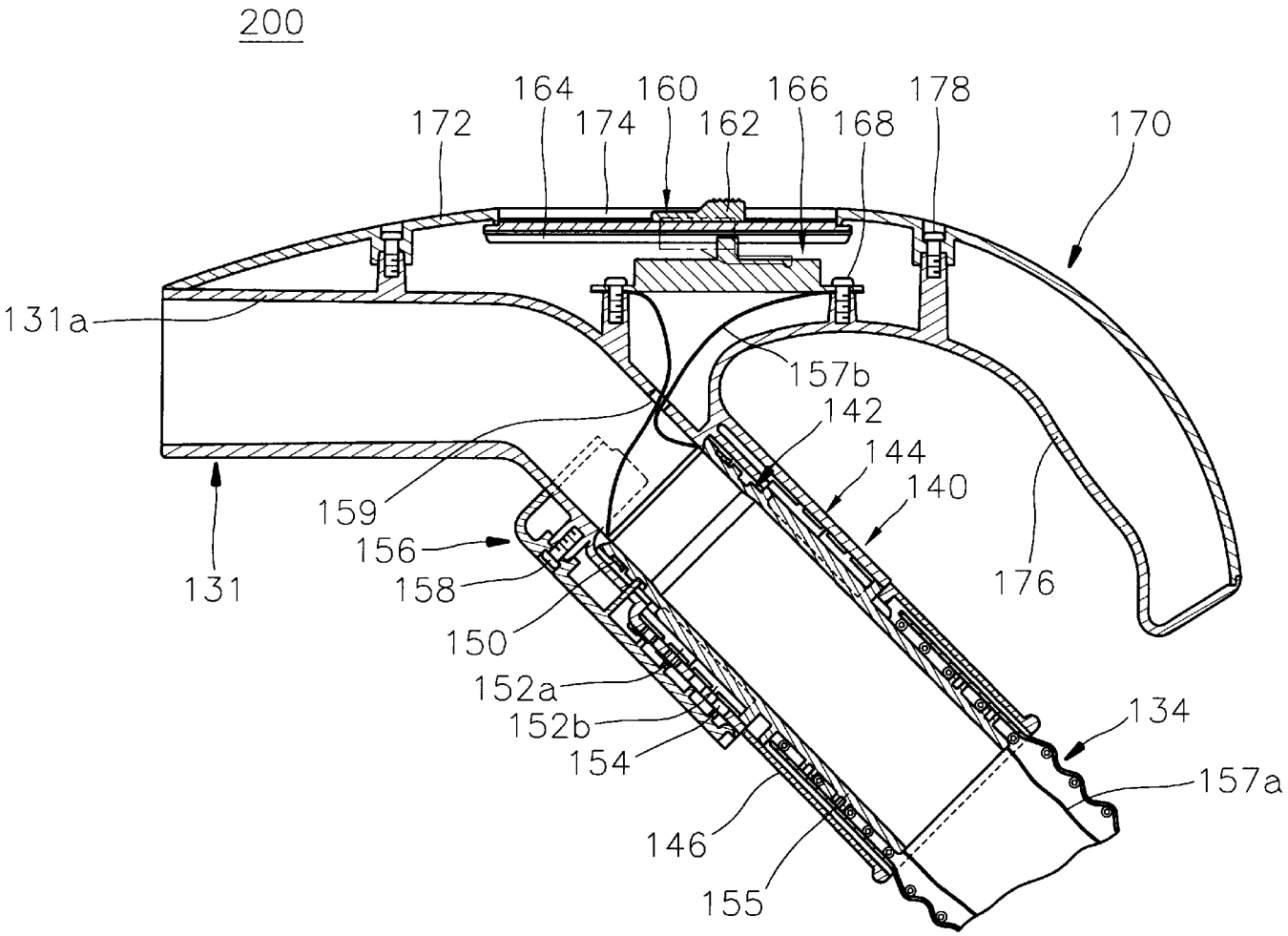
FIG. 7 (PRIOR ART)
FIG. 7 is a partially exploded sectional view of a handle assembly for a vacuum cleaner according to a prior art.

FIG. 4 illustrates in detail a combining portion between distal end 137 of connector 131 and front end 302 of rotating connection portion 300 according to the preferred second embodiment of the present invention. In order to connect distal end 137 of connector 131 to front end 302 of rotating connection portion 300, a first groove 362 is formed on an outer periphery of distal end 137 of connector 131. Further, a second groove 364 is formed on an inner periphery of front end 302 of rotating connection portion 300. An elastic hook-shaped fixing member 360 is inserted and fixed in first groove 362 and second locking groove 364.

When distal end 137 of connector 131 is inserted into front end 302 of rotating connection portion 300 in order to rotatably connect connector 131 with flexible hose 134, hook-shaped fixing member 360 is slideably inserted into first groove 362 and second groove 364. That is, if a user of vacuum cleaner 100 pushes distal end 137 of connector 131 towards rotating connection portion 300 in order to rotatably connect pipe hoses 131 with flexible hose 134, hook-shaped fixing member 360 is pushed and inserted into first locking groove 362 and second groove 364 in due sequence by a force applied by the user. Thereby, distal end 137 of connector 131 and front end 302 of rotating connection portion 300 are connected with each other.

If the user rotates handle 400 under the state that distal end 137 of connector 131 and front end 302 of rotating connection portion 300 are connected to each other as described above, hook-shaped fixing member 360 rotates in first groove 362 and second locking groove 364 in accordance with the rotating of distal end 137 of connector 131 in relation to front end 302 of rotating connection portion 300. As a result, connector 131 and rotating connection portion 300 can rotate together in 360 degrees.

As described above, in the handle assembly of the vacuum cleaner according to the preferred embodiments of the present invention, suction control switch 330, which is improved as compared with the conventional suction control switch 140, is installed in rotating connection portion 300, and the elastic C-shaped ring 304 or the elastic hook-shaped fixing member 360 is disposed at the combining portion between pipe hose 131 and rotating connection portion 300. As a result, it is possible to obtain a handle assembly having a simple internal structure and a low manufacturing cost.

Further, since rigid wand 132 and flexible hose 134 of the vacuum cleaner can rotate together in 360 degrees, a user of the vacuum cleaner can perform a cleaning job by moving the handle assembly into various positions as needed. In addition, it is possible to effectively prevent flexible hose 134 from twisting during the use of the vacuum cleaner. Further, it is possible to effectively prevent lead wire 312 from twisting or shorting during the use of the vacuum cleaner.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A handle assembly for a vacuum cleaner, said handle assembly comprising:

a connector for separably receiving an end of a rigid wand of the vacuum cleaner, the connector including a button section, a supporting means for elastically supporting said button section, a rib for fixing said supporting means, and a cover mounted to said rib, said button section being exposed to an outside of said cover for manual actuation, said supporting means being positioned below said button section;

a handle curved to a predetermined shape so that a user of the vacuum cleaner can conveniently grip said handle by hand, said handle being integrally formed with said connector, said rib extending in a handle extending direction from a free end of said connector to an interior of said handle; and a rotating connection portion for rotatably connecting said connector with a flexible hose of the vacuum clean, said rotating connection portion having a suction control switch which is installed at a side portion of said rotating connection portion.

2. A handle assembly is claimed in claim 1, wherein said button section is exposed to the outside of said cover through an opening which is formed through said cover, and said button section includes a body, a bracket for fixing said supporting means, and a protrusion, said bracket extending downward from said body, said protrusion extending from said body toward an opening end of said connector, and said protrusion being inserted in a groove which is formed through an outer periphery of the rigid wand so as to engage the rigid wand with said connector.

3. A handle assembly as claimed in claim 1, wherein said supporting means is a compression spring.

4. A handle assembly as claimed in claim 1, wherein said suction control switch includes an operation knob, a variable resistor for changing a voltage applied to a driving motor of the vacuum cleaner in accordance with a displacement of said operation knob, a lead wire for applying an electric power from an outer electric source to said variable resistor and for applying a changed voltage which is changed by said variable resistor to the driving motor, and a switch cover for enclosing said operation knob, said variable resistor, and said lead wire, said operation knob being exposed to an outside so that a user of the vacuum cleaner controls an operation of the vacuum cleaner, said variable resistor being slideably brought into contact with said operation knob, and said lead wire being connected to a lower end of said variable resistor.

5. A handle assembly as claimed in claim 4, wherein said operation knob is exposed to the outside through a sliding groove which is formed through a frame of said rotating connection portion, and said operation knob slideably moves in the longitudinal direction along said sliding groove and slideably makes contact with said variable resistor, when the user operates said operation knob in order to change a voltage applied to the driving motor.

6. A handle assembly as claimed in claim 4, wherein said lead wire extending from the lower end of said variable resistor is electrically connected to an inner wire which extends from the outer electric source into the flexible hose.

7. A handle assembly as claimed in claim 1, wherein said connector includes a first annular groove which is formed through an outer periphery of a distal end of said connector, and an elastic C-shaped ring which is inserted into and fixed in said first annular groove, and said rotating connection portion includes a second annular groove which is formed through an inner periphery of a front end of said rotating connection portion, said second annular groove corresponding to said first annular groove.

8. A handle assembly as claimed in claim 7, wherein said C-shaped ring is elastically inserted into said second annular groove at the time that the distal end is inserted into the front end, thereby said connector and said rotating connection portion are rotatably connected with each other.

9. A handle assembly is claimed in claim 1, wherein said connector includes a first groove which is formed through an outer periphery of a distal end of said connector, said rotating connection portion includes a second groove which is formed through an inner periphery of a front end of said rotating connection portion, and when the distal end is inserted into the front end, an elastic hook-shaped fixing member is inserted into said second groove and said first groove in due sequence, thereby rotatably connecting said connect and said rotating connection portion with each other, said second groove corresponding to said first groove.

10. A handle assembly for a vacuum cleaner, said handle assembly comprising:

a connector for separably receiving an end of a rigid wand of a vacuum cleaner, said connector including a first annular groove which is formed through an outer periphery of a distal end of said connector, and an elastic C-shaped ring which is inserted into and fixed in said first annular groove;

a handle curved to a predetermined shape so that a user of the vacuum cleaner can conveniently grip said handle by hand, said handle being integrally formed with said connector; and a rotating connection portion for rotatably connecting said connector with a flexible hose of the vacuum cleaner, said rotating connection portion including a suction control switch which is installed in one side of said rotating connection portion, said rotating connection portion including a second annular groove which is formed through an inner periphery of a front end of said rotating connection portion, and said second annular groove corresponding to said first annular groove.

11. A handle assembly as claimed in claim 10, wherein said connector includes a button section, a compression spring for elastically supporting said button section, and a rib for fixing a lower end of said compressing spring and a cover of said handle, said button section exposed to an outside so that the user can press said button section by hand, said compression spring being positioned below said button section, and said rib extending in the horizontal direction from a free end of said connector to an interior of said handle.

12. A handle assembly as claimed in claim 11, wherein said button section is exposed to the outside through an opening which is formed through said cover, and said button section includes a body, a fixing member for fixing an upper end of said compression spring, and a locking protrusion, said fixing member extending downward from said body, said locking protrusion extending in the horizontal direction from said body toward an opening end of said connector, and said locking protrusion being inserted in a groove which is formed through an outer periphery of the rigid wand, when the rigid wand is inserted into said connector.

13. A handle assembly as claimed in claim 10, wherein said suction control switch includes an operation knob, a variable resistor for changing a voltage applied to a driving motor of the vacuum cleaner in accordance with a displacement of said operation knob, a lead wire for applying an electric power from an outer electric source to said variable resistor and for applying a changed voltage which is changed by said variable resistor to the driving motor, and a switch cover for enclosing said operation knob, said variable resistor, and said lead wire, said operation knob being exposed to an outside so that a user of the vacuum cleaner controls an operation of the vacuum cleaner, said variable resistor being slideably brought into contact with said operation knob, and said lead wire being connected to a lower end of said variable resistor.

14. A handle assembly as claimed in claim 13, wherein said operation knob is exposed to the outside through a groove which is formed through a frame of said rotating connection portion, and said operation knob slideably moves in the longitudinal direction along said groove and slideably makes contact with said variable resistor, when the user operates said operation knob in order to change a voltage applied to the driving motor.

15. A handle assembly as claimed in claim 13, wherein said lead wire extending from the lower end of said variable resistor is electrically connected to an inner wire which extends from the outer electric source into the flexible hose.

16. A handle assembly as claimed in claim 10, wherein said C-shaped ring is elastically inserted into said second annular groove at the time that the distal end is inserted into the front end, thereby said connector and said rotating connection portion are rotatably connected with each other.

17. A handle assembly for a vacuum cleaner, said handle assembly comprising:

a connector for separably receiving an end of a rigid wand of a vacuum cleaner, said connector including a first locking groove which is formed through an outer periphery of a distal end of said connector;

a handle curved to a predetermined shape so that a user of the vacuum cleaner can conveniently grip said handle by hand, said handle being integrally formed with said pipe connector;

a rotating connection portion for rotatably connecting said connector with a flexible hose of the vacuum cleaner, said rotating connection portion including a suction control switch which is installed in one side of said rotating connection portion, said rotating connection portion including a second groove which is formed through an inner periphery of a front end of said rotating connection portion, and said second groove correspondingly to said first groove; and an elastic hook-shaped fixing member being inserted into said second locking groove and said first groove in due sequence, when the distal end is inserted into the front end.

18. A handle assembly as claimed in claim 17, wherein said connector includes a button section, a compression spring for elastically supporting said button section, and a rib for fixing a lower end of said compression spring and a cover of said handle, said button section being exposed to an outside so that the user can press said button section by hand, said compression spring being positioned below said button section, and said rib extending in the horizontal direction from a free end of said connector to an interior of said handle.

19. A handle assembly as claimed in claim 18, wherein said button section is exposed to the outside through an opening which is formed through said cover, and said button section includes a body, a fixing member for fixing an upper end of said compression spring, and a locking protrusion, said fixing member extending downward from said body, said locking protrusion extending in the horizontal direction from said body toward an opening end of said connector, and said locking protrusion being inserted in a groove which is formed through an outer periphery of the rigid wand, when the rigid wand is inserted into said connector.

20. A handle assembly as claimed in claim 17, wherein said suction control switch includes an operation knob, a variable resistor for changing a voltage applied to a driving motor of the vacuum cleaner in accordance with a displacement of said operation knob, a lead wire for applying an electric power from an outer electric source to said variable resistor and for applying a changed voltage which is changed by said variable resistor to the driving motor, and a switch cover for enclosing said operation knob, said variable resistor, and said lead wire, said operation knob being exposed to an outside so that a user of the vacuum cleaner controls an operation of the vacuum cleaner, said variable resistor being slideably brought into contact with said operation knob, and said lead wire being connected to a lower end of said variable resistor.

21. A handle assembly as claimed in claim 20, wherein said operation knob is exposed to the outside through a sliding groove which is formed through a frame of said rotating connection portion, and said operation knob slideably moves in the longitudinal direction along said sliding groove and slideably makes contact with said variable resistor, when the user operates said operation knob in order to change a voltage applied to the driving motor.

22. A handle assembly as claimed in claim 20, wherein said lead wire extending from the lower end of said variable resistor is electrically connected to an inner wire which extends from the outer electric source into the flexible hose.

* * * * *